US008251224B2

(12) United States Patent
Meger

(10) Patent No.: US 8,251,224 B2
(45) Date of Patent: Aug. 28, 2012

(54) PRODUCT PACKAGING WITH EXPANDING STRUCTURES

(75) Inventor: Jody L. Meger, Long Beach, CA (US)

(73) Assignee: Mattel, Inc., El Segundo, CA (US)

( * ) Notice: Subject to any disclaimer, the term of this patent is extended or adjusted under 35 U.S.C. 154(b) by 756 days.

(21) Appl. No.: 11/754,147

(22) Filed: May 25, 2007

(65) Prior Publication Data

US 2008/0029429 A1 Feb. 7, 2008

Related U.S. Application Data

(60) Provisional application No. 60/808,876, filed on May 25, 2006.

(51) Int. Cl.
*B65D 25/54* (2006.01)

(52) U.S. Cl. ..... 206/779; 206/769; 446/73; 446/487; 446/314

(58) Field of Classification Search ..... 206/763, 206/45.31, 45.11, 779; 446/73, 219, 478, 446/487, 251, 314; 223/107; 46/13, 11, 46/12, 32, 122, 137; 273/85
See application file for complete search history.

(56) References Cited

U.S. PATENT DOCUMENTS

| | | | | |
|---|---|---|---|---|
| 1,258,788 | A | | 3/1918 | Koch |
| 1,279,866 | A | | 9/1918 | Henschel |
| 1,343,065 | A | | 6/1920 | Suyehiro |
| 1,517,030 | A | | 11/1924 | Talcott |
| 1,551,666 | A | | 9/1925 | Jensen et al. |
| 1,567,849 | A | | 12/1925 | Kliner |
| 1,746,595 | A | | 2/1930 | King |
| 1,853,116 | A | | 4/1932 | Erickson |
| 1,918,375 | A | | 7/1933 | Bowersock et al. |
| 2,000,618 | A | | 5/1935 | Schultz |
| 2,124,352 | A | | 7/1938 | Patten |
| 2,219,507 | A | | 10/1940 | Apgar et al. |
| 2,262,700 | A | | 11/1941 | Reed |
| 2,428,628 | A | | 10/1947 | Keston |
| 2,441,076 | A | | 5/1948 | Makrianes |
| 2,441,761 | A | | 5/1948 | Guelicher |
| 2,544,833 | A | | 5/1951 | Hammond et al. |
| 2,872,753 | A | | 2/1959 | Fenton |
| 3,078,615 | A | | 2/1963 | Smith |
| 3,182,420 | A | | 5/1965 | Bender |
| 3,231,942 | A | | 2/1966 | O'Brien |
| 3,341,987 | A | | 9/1967 | Johansson |
| 3,363,360 | A | | 1/1968 | Ryan |
| RE26,642 | E | | 8/1969 | Bender |
| 3,773,249 | A | * | 11/1973 | Hidding ..... 16/410 |
| 4,048,748 | A | | 9/1977 | Glazer |
| 4,067,137 | A | | 1/1978 | Korthase |

(Continued)

FOREIGN PATENT DOCUMENTS

| | | |
|---|---|---|
| GB | 2295044 | 5/1996 |

(Continued)

*Primary Examiner* — David Fidei
*Assistant Examiner* — Raven Collins
(74) *Attorney, Agent, or Firm* — Kolisch Hartwell, PC

(57) ABSTRACT

A product packaging with expanding structures. The product packaging includes a body configured to house a toy. The body includes a central section configured to receive the toy, a front section coupled to the central section and having a transparent region configured for viewing the toy and a storage region for receiving an accessory, and a rear section configured to rotate relative to the central section and having expandable features.

17 Claims, 2 Drawing Sheets

U.S. PATENT DOCUMENTS 4,070,789 A 1/1978 Levenson
4,146,983 A 4/1979 Penick et al.
4,165,579 A * 8/1979 Chase ..... 446/73
4,190,978 A 3/1980 Nelson
4,212,231 A 7/1980 Penick et al.
4,349,983 A 9/1982 Kilroy et al.
4,468,020 A 8/1984 Wallace
4,504,000 A * 3/1985 Doyel ..... 223/107
4,508,519 A * 4/1985 Becker ..... 446/478
4,592,573 A 6/1986 Crowell
4,603,658 A 8/1986 Garnsey
4,883,443 A 11/1989 Chase
4,898,404 A 2/1990 Babcock
4,910,899 A 3/1990 Alperin
4,964,249 A 10/1990 Payne
5,013,278 A * 5/1991 Dixon et al. ..... 446/73
5,019,010 A 5/1991 Nikaido et al.
5,055,083 A 10/1991 Walker et al.
5,096,204 A 3/1992 Lippman
5,104,124 A * 4/1992 Bernard et al. ..... 273/317.3
5,183,427 A 2/1993 Draper
5,259,133 A 11/1993 Burtch
5,293,706 A 3/1994 Wood
5,317,823 A 6/1994 Brunt
5,423,709 A 6/1995 Summers
5,429,432 A 7/1995 Johnson
5,452,846 A 9/1995 Myers
5,495,947 A * 3/1996 Zarske ..... 206/579
5,562,520 A 10/1996 Pridonoff et al.
5,681,199 A 10/1997 Morris
5,682,999 A 11/1997 Larson
5,738,221 A 4/1998 Van et al.
5,830,033 A 11/1998 Piron
5,864,973 A 2/1999 Cole
5,868,599 A 2/1999 Kaufman
5,931,099 A 8/1999 Bruner et al.
5,933,989 A 8/1999 Volkert et al.
5,943,800 A 8/1999 Rose
5,961,149 A 10/1999 Hunt
6,108,982 A 8/2000 Davison
6,146,238 A 11/2000 Daiber
6,199,308 B1 3/2001 Westendorp
6,203,017 B1 3/2001 Schultz
6,386,370 B1 5/2002 Wigton et al.
D471,445 S * 3/2003 Kohl ..... D9/614
6,540,580 B1 * 4/2003 Wolfram ..... 446/250
6,554,685 B2 4/2003 Lish
6,607,421 B1 8/2003 Rossi
6,725,588 B1 4/2004 Swoboda
6,752,436 B1 6/2004 Verdillon
6,769,588 B2 * 8/2004 Zheng ..... 224/576
6,966,135 B1 11/2005 McDonald
7,018,267 B2 3/2006 Delaney et al.
7,287,647 B1 * 10/2007 Licciardi ..... 206/579
2005/0051678 A1 3/2005 Modesto
2006/0099875 A1 5/2006 Cartlidge
2006/0283775 A1 12/2006 Mark

FOREIGN PATENT DOCUMENTS

WO 9709102 3/1997

* cited by examiner

PRODUCT PACKAGING WITH EXPANDING STRUCTURES

CROSS-REFERENCE TO RELATED APPLICATIONS

This application claims priority under 35 U.S.C. 119(e) to U.S. Provisional Patent Application No. 60/808,876 entitled "PRODUCT PACKAGING WITH INTEGRAL POP-UP DISPLAY," filed May 25, 2006, the disclosure of which is incorporated herein by reference.

BACKGROUND

Children enjoy playing and interacting with characters in the form of dolls, action figures, stuffed animals, and other toys. Play structures designed to be used in conjunction with such toys enhance the user's ability to enjoy interaction with the characters. Unfortunately, such play structures are often large, bulky, and contain many small pieces or components that may be lost. These aspects of the traditional play structure make it difficult for users, particularly children, to transport the structure from one place to another. Further, purchasing play structures in addition to the toys may be cost prohibitive.

Examples of play structures and structures having expandable features are found in U.S. Pat. Nos. 1,258,788, 1,279,866, 1,343,065, 1,517,030, 1,551,666, 1,567,849, 1,746,595, 1,853,116, 1,918,375, 2,000,618, 2,124,352, 2,219,507, 2,262,700, 2,428,628, 2,441,076, 2,441,761, 2,544,833, 2,872,753, 3,078,615, 3,182,420, 3,231,942, 3,341,987, 3,363,360, 4,048,748, 4,067,137, 4,070,789, 4,146,983, 4,190,978, 4,212,231, 4,349,983, 4,468,020, 4,508,519, 4,592,573, 4,603,658, 4,883,443, 4,898,404, 4,910,899, 4,964,249, 5,013,278, 5,019,010, 5,055,083, 5,096,204, 5,104,124, 5,183,427, 5,259,133, 5,293,706, 5,317,823, 5,423,709, 5,429,432, 5,452,846, 5,562,520, 5,681,199, 5,682,999, 5,738,221, 5,830,033, 5,864,973, 5,868,599, 5,931,099, 5,933,989, 5,943,800, 5,961,149, 6,108,982, 6,146,238, 6,199,308, 6,203,017, 6,386,370, 6,554,685, 6,607,421, 6,725,588, 6,752,436, 6,966,135, 7,018,267, and RE 26,642; U.S. Patent Application Publication Nos. 2005/0051678, 2006/0099875, and 2006/0283775; Foreign Patent No. GB 2295044; and International Publication No. WO 97/009102, the disclosures of which are incorporated herein by reference, in their entirety and for all purposes.

SUMMARY

The disclosed product packaging includes a body configured to house a toy. The body may include a plurality of sections to receive a toy and associated accessories and provide additional play features. The body may include a first section configured to receive the toy, a second section coupled to the first section and having a transparent region configured for viewing the toy and a storage region for receiving an accessory, and a third section configured to move relative to the second section and having expandable features.

The advantages of the disclosed packaging may be understood more readily after a consideration of the drawings and the Detailed Description.

DETAILED DESCRIPTION

To enhance a user's ability to enjoy playing with toys, such as dolls and/or action figures, a scene or environment may be provided to be used in conjunction with the toys. Such scenes and environments may depict a place or play area which mimics where the toy may be found, either in reality or in a fictional setting, thus playing off a theme of the toy. One example of such a play area is an expanding structure or "pop-up," in which users are able to open a book or similar device thereby permitting the structure inside to expand. The structure that expands may provide a mechanism by which a user may play with one or more toys in an area corresponding with the theme of the toy.

Figure 1:
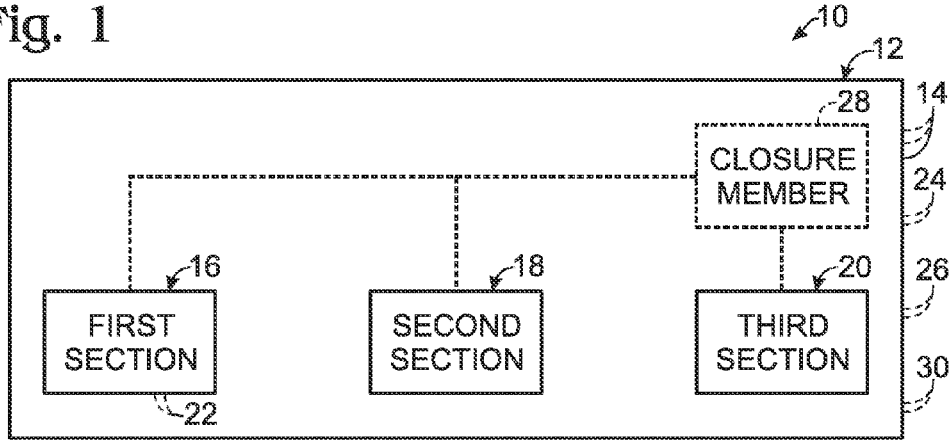
FIG. 1 is a schematic diagram of a packaging according to the present disclosure.

FIG. 1 depicts a schematic diagram of an exemplary product packaging 10. The packaging includes a body 12 having external sides 14. The body may include any number of sides depending on the configuration of the packaging, such as four, five, six, seven, and the like. The body may have a variety of sections depending on the desired functions of the packaging. In the example in FIG. 1, the body includes a first or front section 16, a second or central section 18, and a third or rear section 20. The second section may be configured to house, or otherwise receive, one or more items, such as toys. The first section may be coupled to the second section and be configured for viewing the contents of the second section. The first section may therefore include one or more transparent regions 22. Packaging 10 may include one or more storage regions 24 for receiving one or more items. For example a storage region may be mounted to or integrally formed with the first section. The third section may be coupled to the second section and configured to move relative to the second section. For example, the third section may rotate, pivot, slide, fold, roll, translate, or otherwise move relative to the second section. The third section may be coupled to the second section along a side or edge of the second section that is opposite or adjacent to the first section.

As further shown in FIG. 1, packaging 10 may include expandable features 26 that are configured to extend from the body. For example, the third section may include expandable features 26 that are configured to extend from the third section, such as when the third section is moved relative to the second section. The body may include a closure member 28 mounted to one of the sections and configured to engage another section to retain the body in a closed configuration. For example, the third section may include a closure member that selectively engages the first and/or second sections and thereby retains the third section in a closed configuration in which the expandable features are not visible. The body may include one or more handles 30 to assist a user in carrying the packaging.

The various sections of the packaging may include a scene or environment consistent with the theme of the associated toy and/or accessory. The scene or environment may be conveyed to a user through graphics, legends, movable structures, textures, and the like.

Figure 2:
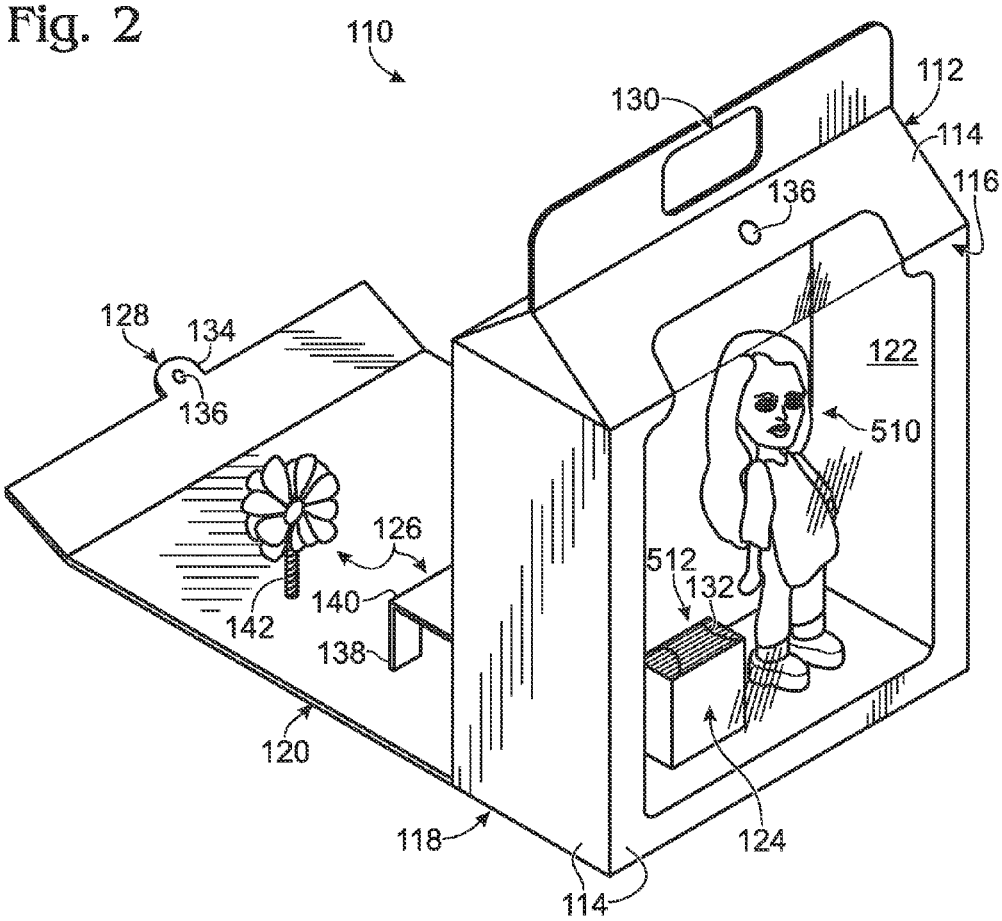
FIG. 2 is a front perspective view of an exemplary packaging in accordance with FIG. 1.

FIG. 2 illustrates an exemplary packaging 110 in which at least a portion of body 112 is configured to house one or more toys 510, such as dolls, action figures, stuffed animals, robots, and the like. The body may be configured to house one or more accessories 512, such as books, hair accessories, toy weapons, and the like, that are associated with toy 510. For example, accessory 512 may include a booklet, pamphlet, or other writing that tells a story or gives information concerning a character inside the packaging. The toys and accessories may be housed on the interior of the body or on the exterior of the body, such as supported on the exterior of the body so as to be easily accessible to a user without opening a portion of the body.

In the example shown in FIG. 2, body 112 includes a front section 116, a central section 118, and a rear section 120. The central section is configured to receive one or more toys and/or accessories and may include any suitable mounting mechanisms, such as clips, ties, and any other suitable retaining member.

As shown in FIG. 2, front section 116 is coupled to central section 118 and includes a transparent region 122 configured for viewing the toy. The transparent region may be formed by a plastic film or other substance so as to permit a user to see the contents of the packaging. The transparent region may extend across more than one side 114 of the body, such as across a portion of the front and top sides of the body, as shown in FIG. 2.

Body 112 may include one or more storage regions 124 for receiving one or more items, such as one or more of the toys and/or accessories. Storage region 124 may take the form of a sleeve or pouch-like structure. The storage region may be mounted to the front section, as shown in FIG. 2, or any other suitable section of the body. In some versions of packaging 10, the storage region may be integrally formed with the body. The storage region may include one or more fasteners 132 adapted to retain the item within the storage region. Fastener 132 may take any suitable form including, but not limited to, elastic bands, snaps, hook-and-loop closure material, and the like.

The rear section may be configured to move relative to the central section, such as along a top edge, a bottom edge, either side edge, and the like. The rear section may include a closure member 128 to engage the front section and thereby restrict access to the central section. In the example of FIG. 2, the closure member takes the form of a tab 134 that engages the front portion via hook-and-loop materials 136. As shown in FIG. 2, rear section 120 is configured to rotate along a bottom edge of the body. Rear section 120 may therefore be used as a base or backdrop of a play area when rotated away from the central section to an open configuration in which the expandable features 126 are visible.

Expandable features or structures 126 may include pop-up structures 138 that automatically expand as the rear section is moved away from the central section. The pop-up structures may be integrally formed with any suitable portion of the body and may include folds 140. Expandable features 126 may include movable structures mounted by springs 142, and the like. In the example shown in FIG. 2, expandable features 126 include spring-mounted representations of flowers that expand automatically when the rear section is moved away from the central section.

In some embodiments, the packaging may have handles to assist a user in carrying the packaging and any enclosed toys and/or accessories. The handles may assist a user in manipulating the packaging to an open configuration, such as by moving the rear section away from the rest of the body. The packaging may include any suitable number of handles mounted to any suitable side(s). For example, one handle may be mounted to the front section while another handle is mounted to the rear section. Therefore, as the handles are moved apart a user may access both the expandable features and the contents of the central section, such as by moving a portion of the front section away from the central section to remove the toys and/or accessories. In the example shown in FIG. 2, the front and central sections are slightly longer than the rear section and include handles 130.

As previously noted, the packaging may include a closure member to secure the packaging in a closed configuration. The closure member may be disposed at the top of the packaging, either side of the packaging, between the rear and central sections of the packaging, or any other suitable location, and engage another portion of the packaging, such as an opposing side. The closure member may pass through the handle(s) of the packaging prior to engagement to restrict access to the interior of the packaging, such as by restricting access between the front and central sections in addition to restricting access to the rear section. The closure member may take any suitable form including, but not limited to, snaps, latches, clasps, hook-and-loop closure material, tapes and other adhesives, and the like. In the example shown in FIG. 2, closure member 128 includes a tab 134 that is mounted to the rear section and passes over the central section to engage a portion of the front section, thereby maintaining the packaging in a closed configuration. The tab may be coupled to the front section using hook-and-loop closure material 136. To maintain the packaging in a closed configuration, the closure member may pass through handles 130.

Figure 3:
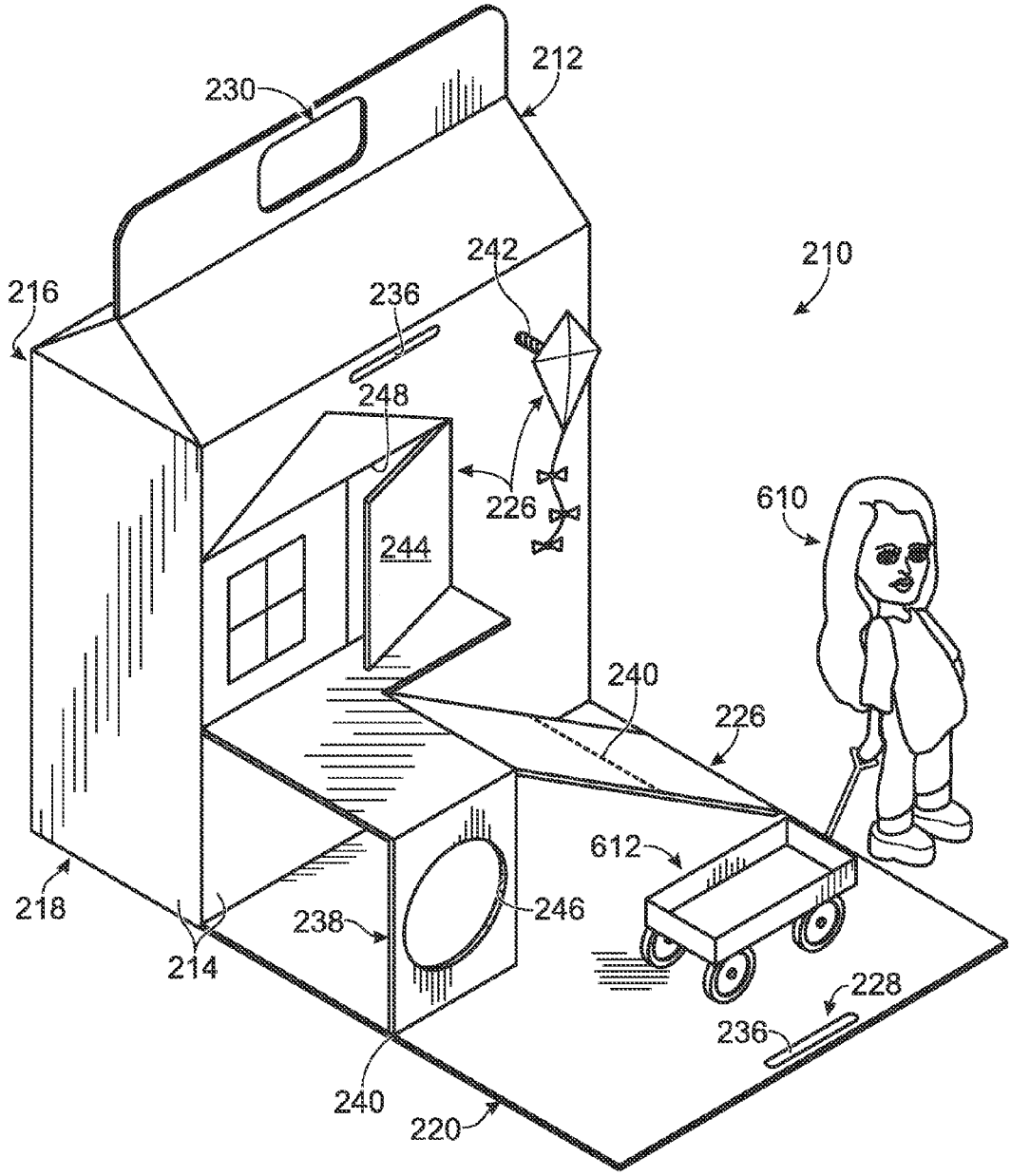
FIG. 3 is a rear perspective view of an exemplary packaging in accordance with FIG. 1.

FIG. 3 illustrates a rear view of another exemplary packaging. Packaging 210 includes a body 212 having external sides 214. Body 212 is configured to house one or more toys 610, such as a doll, and one or more accessories 612, such as a wagon, that are associated with toy 610. The body includes a front section 216, a central section 218, and a rear section 220. The rear section may be coupled to the central section and configured to move relative to the central section. As further shown in FIG. 3, packaging 210 may include expandable features 226 that are configured to extend from the body.

The rear section may include a closure member 228 that selectively engages the central section and thereby retains the rear section in a closed configuration in which the expandable features are not visible. As shown, the closure member may be integrally formed with the rear section. The closure member may be coupled to another portion of the body using hook-and-loop closure material 236. The body may include one or more handles 230 to assist a user in carrying the packaging.

Rear section 220 may be used as a base or backdrop of a play area when rotated away from the central section to an open configuration in which the expandable features 226 are visible. Expandable features or structures 226 may include pop-up structures 238 that automatically expand as the rear section is moved away from the central section. In the packaging shown in FIG. 3, the expandable structures may represent playground structure, such as a slide, clubhouse, and the like. The structures may include apertures 246 to allow a user to maneuver toys and/or accessories through the aperture. The pop-up structures may be integrally formed with any suitable portion of the body and may include folds 240. Expandable features 226 may include movable structures mounted by springs 242, and the like. In the example shown in FIG. 3, a spring-mounted representation of a kite expands automatically when the rear section is moved away from the central section.

The expandable features may include flaps 244 that require further manipulation from a user before opening or otherwise revealing portions of the body. For example, flaps 244 may be moved by a user to reveal objects obstructed by other objects, the interior of cupboards, a view through a window or door, and the like. The flaps may expose a scene imprinted behind the flap, or may expose an opening into a compartment. In the example shown in FIG. 3, flap 244 provides access to an opening 248 in the central section, such as to allow a user to remove items from or deposit items into the central section. The expandable features may be coupled to the body in such a manner that they lie flat between the rear section and the central section when the packaging is in a closed configuration.

As discussed, portions of the packaging may reveal a scene or objects that may be used in connection with toys and/or accessories. The disclosed packaging may represent a space vehicle or environment, an aquatic vehicle or environment, a land vehicle or environment, such as a playground, jungle, zoo, and the like, an occupational vehicle or environment, such as a police car, ambulance, research laboratory, artist's studio, a castle, and the like. The packaging may be shaped to correspond to the theme of the enclosed toys. For example, in configurations in which the packaging represents a dwelling, the packaging may represent different rooms of a home including furniture, appliances, and other items associated with activities of a dwelling. In configurations in which the packaging represents an activity area, the packaging may represent structures to interact with toys by enabling the toys to stand on, slide down, or otherwise interact with the components of the packaging. The packaging may take any suitable shape to represent a particular theme, including but not limited to, a football for a sports theme, a rocket for a space theme, a castle for a fairytale theme, a tree for a jungle theme, and the like.

The disclosed packaging may be fabricated from any suitable material, or combination of materials, such as plastic, foamed plastic, wood, cardboard, pressed paper, metal, or the like. A suitable material may be selected to provide a desirable combination of weight, strength, durability, cost, manufacturability, appearance, safety, ergonomics, and the like. Suitable plastics may include high-density polyethylene (HDPE), low-density polyethylene (LDPE), polystyrene, acrylonitrile butadiene styrene (ABS), polycarbonate, polyethylene terephthalate (PET), polypropylene, ethylene-vinyl acetate (EVA), or the like. Suitable foamed plastics may include expanded or extruded polystyrene, expanded or extruded polypropylene, EVA foam, or the like.

Although the present invention has been shown and described with reference to the foregoing operational principles and preferred embodiments, it will be apparent to those skilled in the art that various changes in form and detail can be made without departing from the spirit and scope of the invention. The present invention is intended to embrace all such alternatives, modifications and variances falling within the scope of the appended claims. Inventions embodied in various combinations and subcombinations of features, functions, elements, and/or properties may be claimed through presentation of claims in a subsequent application.

What is claimed is:

1. A product packaging comprising:

a body configured to house a toy, the body including:

a first section configured to receive the toy;

a second section coupled to the first section and having a transparent region configured for viewing the toy and a storage region for receiving an accessory; and a third section coupled to the first section and configured to move relative to the second section and having expandable features;

wherein at least one of the expandable features is coupled to the first section at a first fold, is coupled to the third section at a second fold and includes at least one predetermined intermediate third fold between the first fold and the second fold;

further wherein the first section includes an opening adjacent the first fold, the opening being smaller than the first section and the third section such that the opening and the at least one expandable feature are revealed when the third section is moved relative to the second section, the opening configured to allow removal of an item from the first section or deposit of an item into the first section.

2. The product packaging of claim 1, wherein the storage region includes a fastener adapted to retain the accessory within the storage region.

3. The product packaging of claim 1, wherein the third section includes a closure member configured to engage a portion of the first section and thereby retain the third section in a closed configuration in which the expandable features are not visible.

4. The product packaging of claim 3, wherein the body further includes at least one handle coupled to one of the first section and the second section, and further wherein the closure member is configured to pass through the at least one handle.

5. The product packaging of claim 1, wherein the expandable features are biased to extend away from the third section.

6. The product packaging of claim 1, wherein the transparent region extends across two or more sides.

7. A product packaging comprising:

a body configured to house a toy, the body including:

a central section configured to receive the toy;

a front section coupled to the central section and having a transparent region configured for viewing a portion of the central section and a storage region for receiving an accessory; and a rear section coupled to the central section and configured to move relative to the central section and having expandable features and a closure member configured to engage a portion of the front section and thereby restrict access to the central section;

wherein the central section includes an opening, the opening being smaller than the central section and the rear section such that the opening and at least one expandable feature are revealed when the third section is moved relative to the second section, the opening configured to allow removal of an item from the central section or deposit of an item into the central section.

8. The product packaging of claim 7, wherein the storage region includes a fastener adapted to retain the accessory within the storage region.

9. The product packaging of claim 7, wherein the closure member is adapted to retain the rear section in a closed configuration in which the expandable features are not visible.

10. The product packaging of claim 7, wherein the body further includes at least one handle coupled to one of the front section and the central section, and further wherein the closure member is configured to pass through the at least one handle.

11. The product packaging of claim 7, wherein the expandable features are biased to extend away from the rear section.

12. The product packaging of claim 7, wherein the transparent region extends across two or more sides.

13. A product packaging comprising:

a body configured to house a toy, the body including:

a central section configured to receive the toy;

a front section coupled to the central section and having a transparent region configured for viewing the contents of the central section and a storage region for receiving an accessory;

a substantially planar rear section configured to move relative to the central section and having expandable features and a closure member;

wherein the closure member is configured to engage a portion of the front section and thereby restrict access to the central section and retain the rear section in a closed configuration in which the expandable features are collapsed, not visible and have a substantially planar configuration; and at least one handle coupled to one of the front section and the central section, wherein the closure member is configured to pass through the at least one handle;

wherein when rear section is moved away from central section, an opening in the central section is revealed, the opening at least partially covered by a moveable flap hingedly attached to the central section adjacent the opening, the flap configured to move transverse the movement of the rear section, the opening configured to allow removal of an item from the central section or deposit of an item into the central section.

14. The product packaging of claim 13, wherein the storage region includes a fastener adapted to retain the accessory within the storage region.

15. The product packaging of claim 14, wherein the expandable features are biased to extend away from the rear section.

16. The product packaging of claim 13, wherein the transparent region extends across two or more sides of the central section.

17. The product packaging of claim 1, wherein the opening at least partially covered by a moveable flap hingedly attached to the first section adjacent the opening, the flap configured to move transverse the movement of the third section.

* * * * *